United States Patent [19]

Hrovat et al.

[11] 4,407,742

[45] Oct. 4, 1983

[54] PROCESS FOR CONDITIONING RADIOACTIVE AND TOXIC WASTES

[75] Inventors: Milan Hrovat, Rodenbach; Hans Huschka; Lothar Rachor, both of Hanau, all of Fed. Rep. of Germany

[73] Assignee: Nukem GmbH, Hanau, Fed. Rep. of Germany

[21] Appl. No.: 143,941

[22] Filed: Apr. 25, 1980

[30] Foreign Application Priority Data

Apr. 28, 1979 [DE] Fed. Rep. of Germany ..... 2917437

[51] Int. Cl.[3] ..... G21F 9/16

[52] U.S. Cl. ..... 252/628; 264/0.5; 264/122

[58] Field of Search ..... 252/301.1 R, 301.1 W, 252/628, 639, 502, 506; 264/0.5, 122; 176/89

[56] References Cited

U.S. PATENT DOCUMENTS

| | | | |
|---|---|---|---|
| 1,017,483 | 2/1912 | Van Brunt | 252/502 |
| 3,758,648 | 9/1973 | Sturge et al. | 176/89 |
| 3,975,471 | 8/1976 | Hrovat et al. | 264/0.5 |
| 3,993,579 | 11/1976 | Bunnell et al. | 252/301.1 W |
| 3,994,822 | 11/1976 | De Bacci et al. | 252/301.1 W |

*Primary Examiner*—Deborah L. Kyle

*Attorney, Agent, or Firm*—Cushman, Darby & Cushman

[57] ABSTRACT

Previously the conditioning of radioactive wastes took place through binding the waste in a matrix of glass, silicon carbide, cement, bitumen, synthetic resin or vitreous carbon. These processes have many disadvantages, particularly the matrix has poor heat conductivity, insufficient resistant to extraction or poor heat resistance and radiolysis effects. A remedy is provided through a carbon matrix in which there is employed as the starting material graphite which is molded with a binder at a temperature above 100° C. There have particularly proven good as the binder sulfur in admixture with nickel powder from which nickel sulfide forms.

13 Claims, No Drawings

PROCESS FOR CONDITIONING RADIOACTIVE AND TOXIC WASTES

BACKGROUND OF THE INVENTION

The invention is directed to a process for the conditioning of radioactive and toxic wastes for transportation and final storage in which waste is bound in a matrix constructed on a basis of carbon and molded into solid blocks.

In the nuclear art there are accumulated radioactive wastes in liquid and solid form in the fuel recycling industry, the nuclear power plants and reprocessing. Distinctions are made in regard to activity as high, average and weakly active wastes. The highly active waste with an activity of greater than $10^4$Ci/cm$^3$ is formed preponderantly in the reprocessing of nuclear fuels. The average active waste with an activity of $10^4$ to $10^{-2}$Ci/cm$^3$ are produced both in the reprocessing as well as in the final recycling industry and in power plant operation.

In order to reduce the stored volumes, customarily the liquid radioactive waste is first concentrated by evaporation and then solidified. For the solidification of highly radioactive waste several processes are known.

Preferably the solidification takes place by calcining in a fluidized bed between 350°-900° C. Thereby there is obtained a mixture of non-volatile oxides and metal components, which can be present as powder or granulate. For safe final storage the powder or granulate is bound into a glass-like matrix and in connection therewith converted into solid blocks.

For the fixation of average and weakly active wastes processes are known according to which the waste material together with e.g. bitumen is heated and subjected to an extrusion process. Thereby the radioactive waste is bound into the bitumen composition and after cooling the solidified composition in transportation casks final stored.

Besides processes were developed according to which the radioactive waste is fixed by cementation. Customarily in these processes the radioactive waste is processed in the form of a sludge which is composed of about 80 weight % of liquid and the residual 20% of solid components. The sludge is mixed with cement for the production of concrete and solidified at room temperatures. The production of concrete optionally can be taken up directly in the transportation tanks for the final storage.

Furthermore processes are known for the fixing of radioactive waste in which the waste is mixed into a polymerizable resin preferably at room temperature and this resin is polymerized with monomers to a solid block.

The previously known processes have a series of disadvantages. The vitrification of the waste takes place at very high temperatures which customarily are above 1000° C. Therefore the process is expensive and dear. The heat conductivity of the glass matrix is low. In order not to exceed an impermissibly high central temperature of the blocks because of the production of heat in the decay of the fission products, the waste concentration and the block diameter is limited to relatively small values. Since the coefficients of thermal expansion of glass and container material are very different there occur in the cooling thermal stresses which can lead to undesired stress corrosion. Besides the cooling time required is very long and can amount to several days.

The bitumenization is a hot process. At relatively high temperatures required for extrusion because of a possible danger of fire there must be taken strong safety precautions which are industrially expensive, susceptible to disturbances and therewith dear.

The substantial disadvantages of the inclusion in cement are a large volume of waste, the frequent poor setting property of the cement in contrast to the included waste solutions, and undesired leaching out of the radioactive waste enclosed in the concrete caused through porosity.

In the binding in the polymerizable synthetic resin it is a matter additionally of hydrocarbon compounds. Therefore there is no guarantee of the retaining capacity for the active gas tritium. Besides through the aging process the brittleness of the synthetic resin can increase and therewith the mechanical integrity of the blocks is endangered.

It is known from DeBacci U.S. Pat. No. 3,994,822 to enclose radioactive waste in a matrix of $\beta$-silicon carbide by "overcoating" the waste particles with silicon carbide and graphite, pressing to a porous shaped article and impregnating with liquid silicon, during which $\beta$-silicon carbide is formed. However, this production of matrix is very expensive and the silicon carbide only has a relatively poor heat conductivity.

According to Bunnell U.S. Pat. No. 3,993,579 radioactive waste is encapsulated in vitreous carbon by covering the particles with a resin and heating to 1000° C. for 150 hours. Here also there is a cumbersome encapsulation process whereby there are producible only thin carbon layers and there is needed an additional metal matrix and a storage container.

Therefore it was the problem of the present invention to provide a process for the conditioning of toxic, especially of radioactive waste for the transportation and the final storage through enclosure in a carbon matrix, which avoids the disadvantages of the known processes and particularly permit the solidification of the waste to non-burnable blocks with higher mechanical and chemical stability, better resistance to extraction, higher heat conductivity and with high resistance to rays of any kind.

SUMMARY OF THE INVENTION

This problem was solved according to the invention by employing graphite as the starting material for the carbon matrix and pressing with a binder at temperatures above 100° C., e.g. up to 500° C. to shaped articles. It is advantageous to employ as starting materials graphite in crystalline form, non-burnable in the air. It is especially recommended to use for this easily moldable natural graphite powder. As binder there can be used both organic and, more preferably, inorganic substances.

In employing organic compounds as binders preferably there are suited polymerization products. In order to produce a simple solidification of the graphite matrix in the binding up of the waste, the polymerization is carried out in the pressing of the blocks under continuous compressing. Thereby for example there are polymerized for example monomeric vinyl compounds with di or polyvinyl compounds under the influence of a catalyst and heat.

As monovinyl compounds there are used, e.g. styrene, acrylic acid, vinyl toluene, butyl acrylate or vinyl pyrrolidone, whereas as polyvinyl compounds there are preferred divinyl benzene (e.g. p-divinyl benzene or o-divinyl benzene, trivinyl benzene (e.g., 1,3,5-trivinyl benzene), polyvinyl-ether, glycerine triacrylate and allyl acrylate.

In addition there are suited as polymerization products which are produced by condensation. Of these synthetic resins phenol formaldehydes resins such as e.g. resoles and novolaks are particularly well suited.

A particularly important class of binders for the graphite matrix is the hydrogen free inorganic compounds. Through the insertion of suitable inorganic compounds such as phosphates, e.g. sodium phosphate or silicates, e.g. sodium silicate or potassium silicate the customarily occurring and undesired radiolysis of the binding matrix is sharply reduced and the ability to retain fission gas-tritium substantially increased. Of the inorganic materials sulfur is particularly well suited as the binder. The sulfur is distinguished by a good hardening ability, by a good chemical stability as well as resistance to rays. Since its melting point is relatively low, about 120° C., the pressing of the block can take place with bound waste at low temperatures and at slight expense. The solidification is preferably carried out in the melting range of sulfur.

In order to produce a high heat resistance of the enclosing or binding matrix which is particularly necessary in the fixing of highly radioactive waste because of the greater decay heat, the sulfur is advantageously converted to a chemically stable and water insoluble metal sulfide having a high melting point.

The sulfur reaction takes place thereby with a metal powder intermixed with the molding powder in the pressing of the blocks through raising the temperature under continuous pressure. As metal powders there can be used all metals which form stable sulfides under storage conditions, e.g. nickel, cobalt, copper, iron, chromium and aluminum. The metals normally are not radioactive. Nickel metal powder has been found to be particularly advantageous. With the insertion of nickel the sulfide reaction proceeds at relatively low temperature and moderate speed. The nickel sulfide formed in the graphite matrix is distinguished by insolubility in water and in sodium chloride solutions. Besides it possesses a high heat conductivity and a very good chemical stability toward the environment.

In the binding up of graphite high temperature fuel elements for final storage there are placed on the matrix additional severe requirements in reference to the capability of retaining the gas tritium.

The spherical high temperature graphite fuel elements customarily consist of a fuel containing nucleus having a diameter of 50 mm which is surrounded by a fuel free shell 5 mm thick. The graphite matrix of the nucleus in which the fuel is embedded in the form of coated particles merges into the same matrix of the shell without fissures. Proportionately 50% of the volume is for the fuel free spherical shell and the residual 50 volume % for the nucleus.

Since the spherical packing density of these fuel elements in the storage containers is only about 55 volume % there results a high space requirement for the intermediate and final storage. According to the invention the fuel free spherical shells are turned and the resulting graphite powder used as starting material for the production of the binding matrix for the fuel containing spherical nuclei. Through this the occupying volumes of the fuel elements to be stored is reduced by about a factor of 2. A further advantage of this procedure is that the carbon isotope C-14 formed during the operation of the reactor is stored in solid form as binding matrix and thus is kept away from recycling to the biosphere.

The substantial advantages of the binding matrix constructed on a graphite basis are summarized as follows.

The matrix is practically insoluble in water and sodium chloride solution. It is resistant to rays of all types and possesses a very good heat conductivity. It is chemically stable and non-reactive to the storage environment. The blocks produced with it show a lasting and high mechanical integrity. The blocks are not burnable and in using sulfur as the binder and nickel powder as additive are high temperature resistant through formation of nickel sulfide.

Since the matrix with inorganic binders contains no hydrogen compounds and is substantially impermeable it has a high capability of retaining tritium gas and is not susceptible to radiolysis. Besides it is resistant to extraction.

The process can comprise, consist essentially of or consist of the steps set forth with the stated materials.

The following examples further explain the invention.

DESCRIPTION OF THE PREFERRED EMBODIMENTS

EXAMPLE 1

As starting material for the production of the binding matrix there served natural graphite powder having a bulk density of 0.4 g/cm$^3$, a crystal size of about 1000 Å and an average particle diameter of 15$\mu$. There were intermixed with the graphite powder 20 weight % phenol-formaldehyde resin binder (novolak) with 1 weight % of hexamethylenetetramine as hardener and 0.5 weight % of stearic acid as lubricant. As a softening point of 101° C. the molecular weight of the resin was about 700. As model material for the radioactive waste, which, e.g. was composed of undissolved uranium, fission products and zirconium shavings, there was used a granulate consisting of a mixture of aluminum oxide, uranium oxide and zirconium oxide. In order to determine the resistance to extraction of the bound, simulated waste, the granulate was doped with sodium chloride. For production of the molding article the molding powder was mixed with the granulate, the mixture conveyed into a die of a press and compressed therein at 120° C. and a specific pressure of 20 MN/m$^2$ (meganewtons/m$^2$). Subsequently the temperature was raised to 200° C. while maintaining the pressure and in connection therewith the binder resin hardened under the influence of the heat. After the ejection at 90° C. the molded article had the following properties:

Granulate packing density: 40 Vol %
Density of the binding matrix: 1.94 g/cm$^3$
Compressive strength: 40 MN/m$^2$
Heat conductivity: 0.2 W/cm °K.

To determine the resistance to extraction there were produced test molded articles whose outer skin did not contain granulates doped with NaCl.

The test articles were suspended in a container filled with distilled water, the amount of water being so selected that the quotient formed between the volume of water and the suspended test surface was more than 10 cm.

After 10 days the sodium content of the water was examined flame photometrically. The speed of extraction determined therefrom was relatively small and amounted to $3\times10^{-4}$ cm/day. The corresponding value for the samples produced with a mixture of cement and silicone resin was about a factor of 17 higher and amounted to $1.8\times10^{-3}$ cm/day.

EXAMPLE 2

The molding powder for the production of matrix was composed of 43.3 weight % natural graphite powder, 20.0 weight % sulfur and 36.7 weight % nickel metal powder. The properties of the natural graphite corresponded to those in Example 1. The sulfur was present in finely ground powder form and corresponded to commercial quality. The nickel metal powder had a bulk density of 2.1 g/cm$^3$; a specific surface area of 0.34 m$^3$/g, an average particle diameter of 5$\mu$ and a purity of 99.8 weight %. In a manner analogous to Example 1 the molding powder was mixed with the doped granulates, the mixture conveyed into a steel die of the press and compressed therein in the melting range of sulfur at 120° C. and a pressure of 80 MN/m$^2$. Subsequently the temperature was raised to about 400° C. while maintaining the pressing pressure and thereby the sulfur was reacted to form nickel sulfide. After the cooling to about 300° C. the molded articles were ejected. At a granulate packing density of 40 Vol % the following properties were ascertained on the molded articles.

Density of the binding matrix: 3.1 g/cm$^3$
Compressive strength: 73.8 MN/m$^2$
Heat conductivity: 0.28 w/cm °K.
Linear thermal expansion: 17.7$\mu$/m °K.

To determine the resistance to extraction there were prepared molded articles as in Example 1 and these were tested under the same conditions. The speed of extraction ascertained was relatively small and amounted to $1.2\times10^{-4}$ cm/day.

EXAMPLE 3

For the binding there were used spherically shaped graphite fuel elements having a diameter of 60 mn. The spheres had a 50 mm size fuel containing nucleus of graphite which was surrounded by a 5 mm thick fuel free graphite shell. The heavy metal was present in the form of oxidic, coated fuel particles and amounted to 11 g/sphere, of which 10 grams was thorium and 1 grams uranium.

In the lathing of the fuel free spherical shell there was obtained a graphite powder having an average particle size of about 100$\mu$. The molding powder for the binding matrix was produced from the graphite powder by dry mixing with 20 weight % sulfur. In order to produce an optimal packing density of the spherical nuclei the molding die was filled with the molding powder and spherical nuclei in layers. The compressing to molded articles took place in the melting range of sulfur at 130° C. and a specific molding pressure of 20 MN/m$^2$. After cooling to about 80° C. the molded articles were ejected from the die. At a packing density of the spherical nuclei of about 40% the binding matrix had the following properties:

Matrix density: 1.72 g/cm$^3$
Heat conductivity: 0.21 W/cm °K.
Compressive strength: 35 MN/m$^2$
E-modulus: $10.6\times10^{-3}$ MN/m$^2$ The entire disclosure of German priority application P2917437.6-33 is hereby relied upon.

We claim:

1. A process for conditioning radioactive and toxic wastes for the transportation and final storage through binding the waste in a carbon matrix comprising employing as the starting material for the carbon matrix natural graphite and pressing with sulfur as a binder at a temperature above 100° C. and in the melting range of sulfur to form a molded article.

2. The product prepared by the process of claim 1.

3. The process of claim 1 wherein there is also employed a powder of a metal which forms a stable sulfide with sulfur.

4. The product prepared by the process of claim 3.

5. The process of claim 3 wherein the metal powder is nickel powder.

6. The product prepared by the process of claim 5.

7. The process of claim 5 wherein there are conditioned spherical high temperatures fuel elements having graphite in the fuel element shells and there is used as the starting material for the carbon matrix the graphite of the fuel element shells.

8. A process for conditioning radioactive and toxic wastes for the transportation and final storage through binding the waste in a carbon matrix comprising employing as the starting material for the carbon matrix graphite and pressing with sulfur as a binder at a temperature above 100° C. and in the melting range of sulfur to form a molded article.

9. The product prepared by the process of claim 8.

10. The process of claim 8 wherein there is also employed a powder of a metal which forms a stable sulfide with sulfur.

11. The product prepared by the process of claim 6.

12. The process of claim 6 wherein the metal powder is nickel powder.

13. The product prepared by the process of claim 12.

* * * * *